US008430650B2

(12) United States Patent
Ohata et al.

(10) Patent No.: US 8,430,650 B2
(45) Date of Patent: Apr. 30, 2013

(54) RECIPROCATIVE COMPRESSOR

(75) Inventors: Akito Ohata, Yokohama (JP); Hisatoshi Kobayashi, Yokohama (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 334 days.

(21) Appl. No.: 12/652,954

(22) Filed: Jan. 6, 2010

(65) Prior Publication Data

US 2010/0303645 A1 Dec. 2, 2010

(30) Foreign Application Priority Data

May 27, 2009 (JP) ..... 2009-127691

(51) Int. Cl.
*F04B 17/00* (2006.01)
*F04B 35/04* (2006.01)

(52) U.S. Cl.
USPC ..... 417/415; 92/240; 92/258; 277/437; 277/451

(58) Field of Classification Search ..... 417/415, 417/237; 92/240, 258; 277/435, 437, 449, 277/451
See application file for complete search history.

(56) References Cited

U.S. PATENT DOCUMENTS 2,218,638 A * 10/1940 Christenson ..... 277/439
2,471,477 A * 5/1949 Bonnaud ..... 92/251
2,985,358 A * 5/1961 Lee et al. ..... 417/490
3,182,569 A * 5/1965 Hieber ..... 92/243
3,961,868 A * 6/1976 Droege et al. ..... 417/550
4,121,838 A * 10/1978 Sakamaki ..... 277/586
4,396,363 A * 8/1983 Sakamaki et al. ..... 417/439
4,915,594 A * 4/1990 Lammers ..... 417/265
5,006,047 A * 4/1991 O'Connell ..... 417/238
5,231,917 A * 8/1993 Wood ..... 92/186
5,664,536 A * 9/1997 Bigsby ..... 123/193.4

FOREIGN PATENT DOCUMENTS

CN 200620002692 U 1/2006
DE 26 28 985 A1 12/1977
JP 2004125159 4/2004
JP 2006-152960 A 6/2006
JP 2007-32532 A 2/2007
JP 2008-297924 A 12/2008

OTHER PUBLICATIONS

Notification of First Office Action mailed Jan. 31, 2012, together with English language translation.

* cited by examiner

*Primary Examiner* — Devon Kramer
*Assistant Examiner* — Joseph Herrmann
(74) *Attorney, Agent, or Firm* — Crowell & Moring LLP

(57) ABSTRACT

A swing-type reciprocative compressor is capable of maintaining long durability and preventing propagation of heat to the large end portion of a piston, even under high-compression. In the reciprocative compressor having a swing-type piston mechanism, a piston ring is attached to a piston ring groove to seal between a piston and a cylinder. A ring groove is provided separately from the piston ring groove on the outer circumferential side of the piston and on the crankshaft side of the piston ring groove. A guide ring restricted from moving in a radial direction and shaped like a skirt opening toward the crankshaft side is provided in the ring groove.

7 Claims, 13 Drawing Sheets

RECIPROCATIVE COMPRESSOR

CLAIMS OF PRIORITY

The present application claims priority from Japanese patent application serial no. JP2009-127691, filed on May 27, 2009, the content of which is hereby incorporated by reference into this application.

BACKGROUND OF THE INVENTION

The present invention relates generally to reciprocative compressors and more particularly to a swing-type reciprocative compressor in which a piston swings in a cylinder, assembly is easy and long endurance can be maintained even under high-pressure compression.

Of compressors for compressing gas, reciprocative compressors have a simple structure and allows for high-compression; therefore, they are used in various fields.

Reciprocative compressors include a piston type in which a piston is rotatably connected to a connecting rod via a bearing mechanism as illustrated in FIG. 7 of JP-A-2008-297924 and a swing type in which a piston rod is integrally combined with a compression-associated part of the upper portion of a piston as described in JP-A-2006-152960.

SUMMARY OF THE INVENTION

Reciprocative compressors are characterized by being capable of high-compression although they have small-sized and simple mechanisms. Users have increasingly requested the reciprocative compressors to achieve high-performance and high-compression.

Incidentally, the swing-type reciprocative compressor shown in JP-A-2006-152960 is configured to have a piston ring attached to the upper portion of the piston. Therefore, it has advantages of simplifying assembly and suppressing manufacturing costs. However, when a swing angle is increased along with the rotation of the piston, misalignment occurs between the center of the piston and that of the cylinder. See FIG. 6 of JP-A-2006-152960.

The piston ring is designed to have such a configuration as to accommodate such misalignment. However, for high-compression, the piston and the inner wall of the cylinder rub together, which poses a major problem of the piston ring "scoring" the cylinder.

The swing-type reciprocative compressor as described above has a simpler configuration of a compression-associated part of the piston and a less metal portion, compared with the reciprocative compressor having a piston structure as in FIG. 7 of JP-A-2008-297924. This poses a problem in that heat is easily transmitted to the large end portion (the rotary shaft side) of a piston rod portion.

Such problems are increased particularly on the high-pressure compression side of multi-stage compression.

The present invention has been made to solve such problems and aims to provide a swing-type reciprocative compressor that can maintain long durability and prevent the propagation of heat to the large end portion of a piston rod portion, even under high-compression.

A reciprocative compressor of the present invention has a swing-type piston mechanism in which a piston ring is attached to a piston ring groove to seal between a piston and a cylinder. A ring groove is provided separately from the piston ring groove on the outer circumferential side of the piston and on the crankshaft side of the piston ring groove. A guide ring restricted from moving in a radial direction is provided in the ring groove.

Preferably, the guide ring is shaped like a skirt opening toward the crankshaft side.

The reciprocative compressor according the configuration of the present invention can deal with further enhanced performance by reducing leak of compressed fluid from the piston ring. In addition, a heat insulating effect by the guide ring can be expected.

According to the present invention, a swing-type reciprocative compressor capable of maintaining long durability and preventing propagation of heat to a large end portion of a piston rod portion can be provided, even under high-compression.

DETAILED DESCRIPTION OF PREFERRED EMBODIMENTS

Preferred embodiments according to the present invention will hereinafter be described with reference to FIGS. 1 to 15.

First Embodiment

A first embodiment according to the present invention will hereinafter be described with reference to FIGS. 1 to 12.

Figure 1:
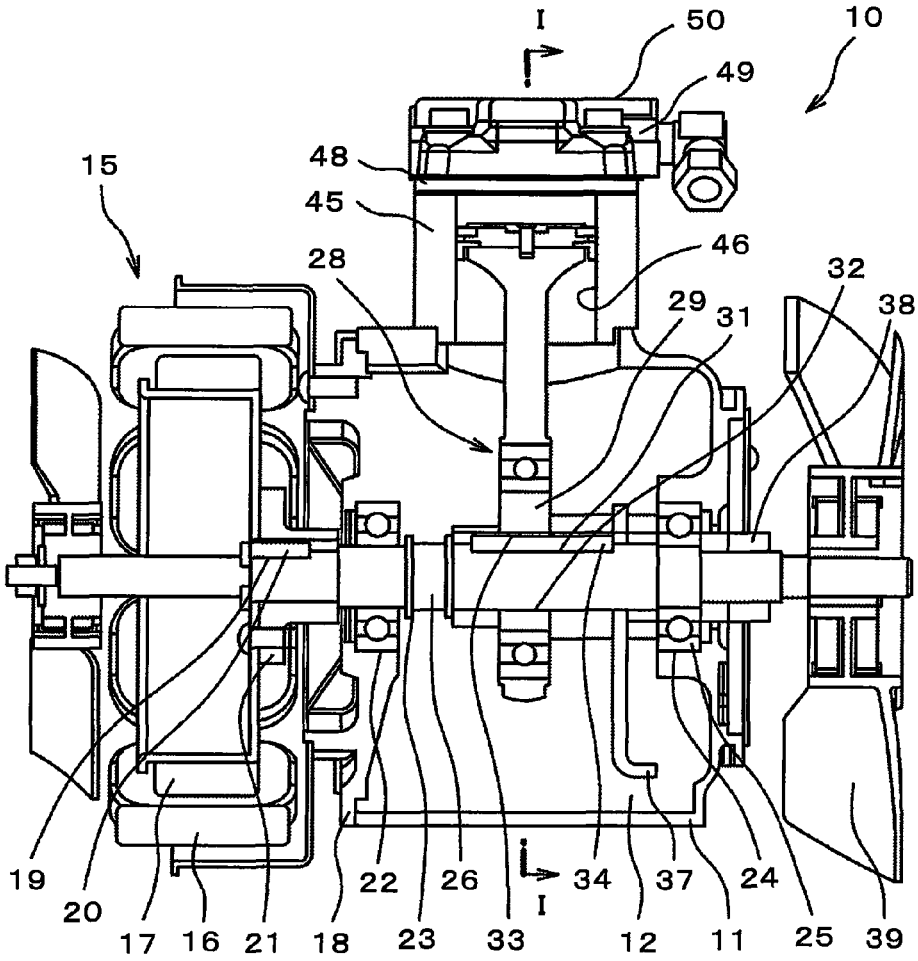
FIG. 1 is a cross-sectional view of a reciprocative compressor according to a first embodiment of the present invention.
Figure 2:
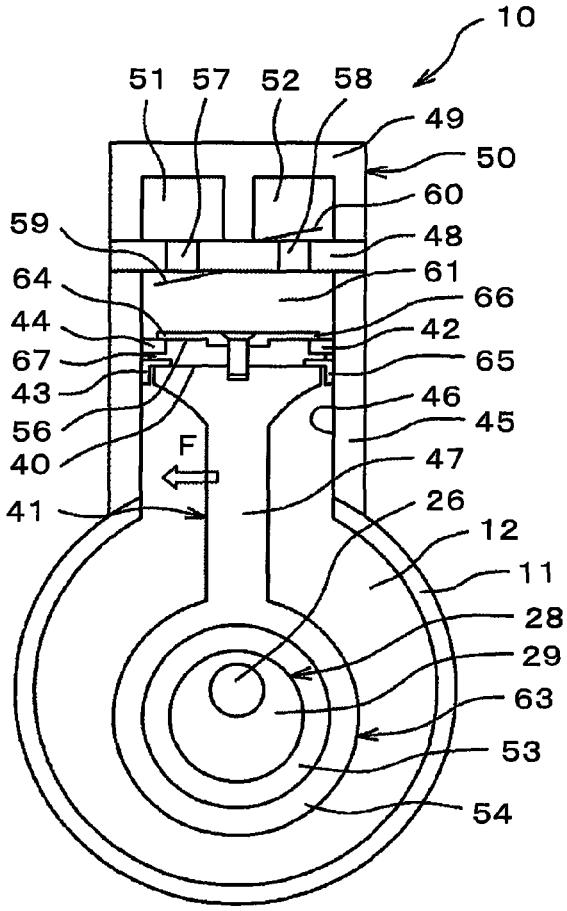
FIG. 2 is a cross-sectional view of the reciprocative compressor according to the first embodiment taken along line I-I of FIG. 1.
Figure 3:
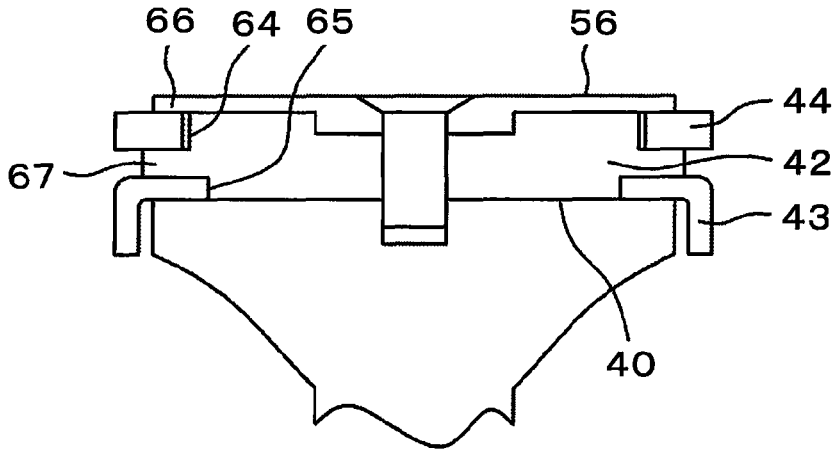
FIG. 3 is an enlarged view illustrating the vicinity of an upper portion of a piston of the reciprocative compressor according to the first embodiment of the present invention.
Figure 4A:
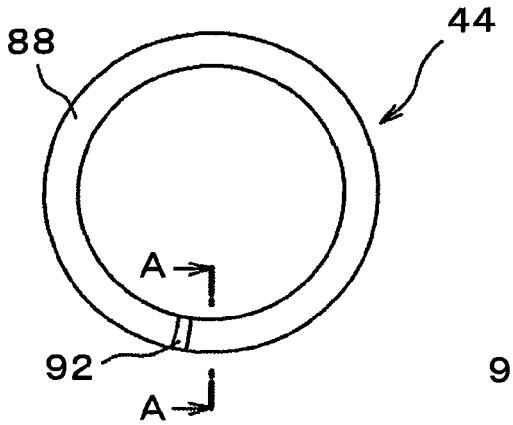
FIGS. 4A, 4B and 4C are views for assistance in explaining a shape of a piston ring 44.
Figure 4C:
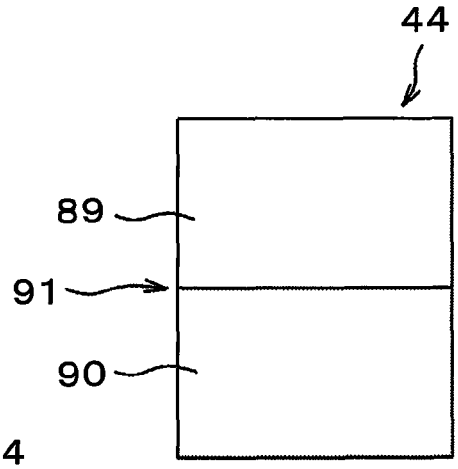
Figure 4B:
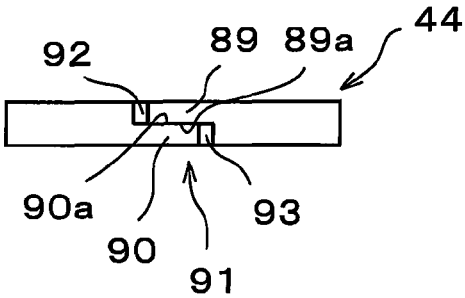
Figure 5A:
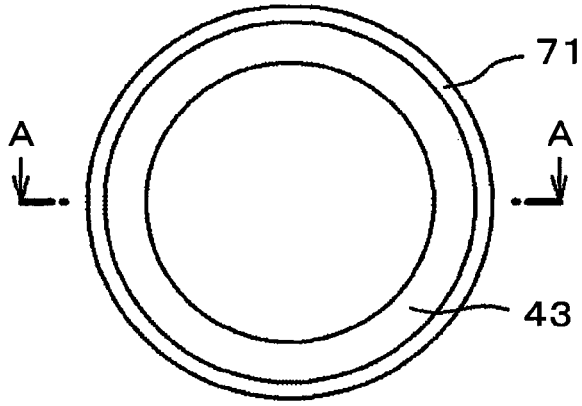
FIGS. 5A and 5B are views for assistance in explaining a shape of a guide ring 43.
Figure 5B:
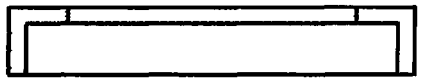
Figure 6:
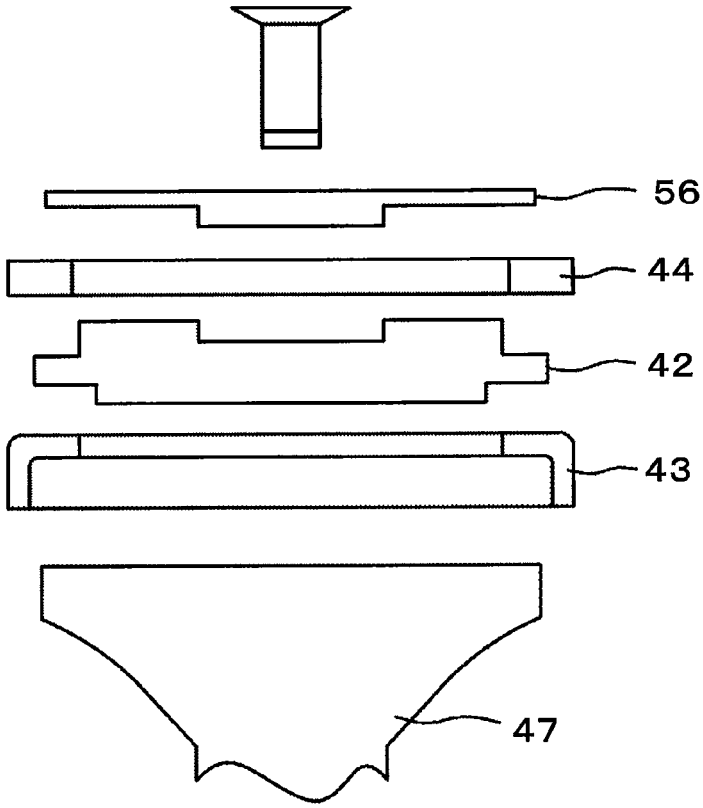
FIG. 6 is an exploded lateral view of parts in the vicinity of the upper portion of the piston.
Figure 7:
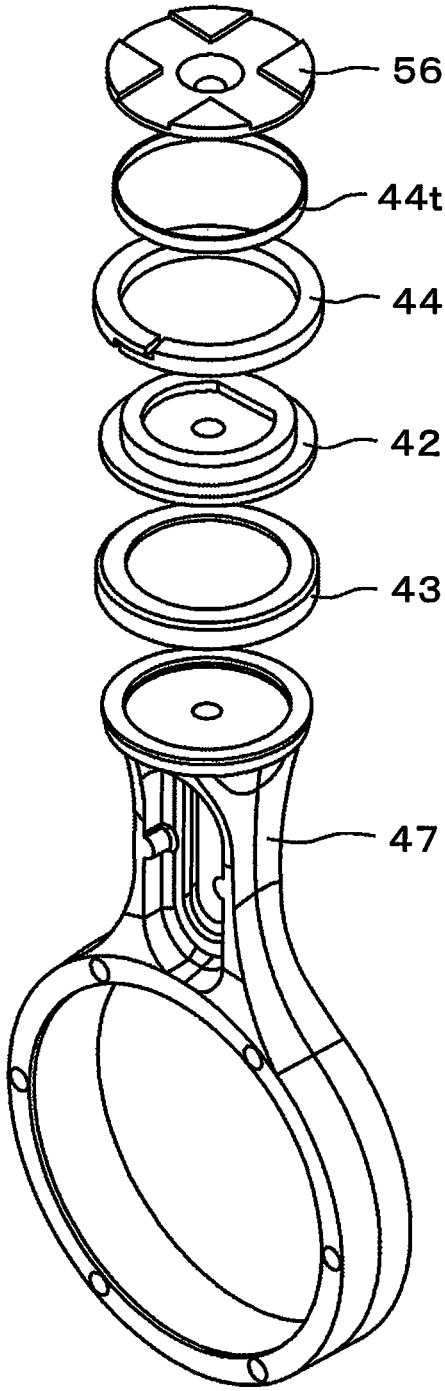
FIG. 7 is an exploded perspective view illustrating a piston rod portion 47 and parts above the piston rod portion 47.

A configuration of a reciprocative compression according to the first embodiment of the present invention is first described with reference to FIGS. 1 to 7. FIG. 1 is a cross-sectional view of the reciprocative compressor according to the first embodiment of the present invention. FIG. 2 is a cross-sectional view of the reciprocative compressor according to the first embodiment taken along line I-I of FIG. 1. FIG. 3 is an enlarged view illustrating the vicinity of an upper portion of a piston of the reciprocative compressor according to the first embodiment of the present invention. FIGS. 4A, 4B and 4C are views for assistance in explaining a shape of a piston ring 44. FIGS. 5A and 5B are views for assistance in explaining a shape of a guide ring 43. FIG. 6 is an exploded lateral view of parts in the vicinity of the upper portion of the piston. FIG. 7 is an exploded perspective view illustrating a piston rod portion 47 and parts above the piston rod portion 47.

The reciprocative compressor 10 sucks in gas (fluid) and compresses and discharges it. Referring to FIGS. 1 and 2, the reciprocative processor 10 has a crankcase 11, the inside of which serves as a crank chamber 12. An electric motor 15 is attached to the crankcase 11 as illustrated in FIG. 1. The electric motor 15 is composed of a stator 16 and a rotor 17. The stator 16 is mounted to a stator holder 18. The rotor 17 is secured to a rotor holding member 21 fitted to a key 20 attached to a key groove 19. The rotor holding member 21 is secured to a bearing 23 held by a bearing holding portion 22 of the crankcase 11 and to an output shaft 26 supported by a bearing 25 held by a bearing holding portion 24.

The output shaft 26 of the electric motor 15 has one end portion projecting into the crank chamber 12, and a crank member 29 is concentrically secured to this projecting end portion. The crank member 29 and the output shaft 26 of the electric motor 15 constitute a crankshaft 28. The output shaft 26 is formed with a key groove 31. The crank member 29 is formed with a fitting hole 32 adapted to receive the output shaft 26 fitted thereinto eccentrically with respect to the outer circumferential portion. In addition, the fitting hole 32 is formed with a key groove 33. A key 34 is fitted into the key grooves 31, 33 to unite the crank member 29 with the output shaft 26. In this way, the crankcase 11 supports the crankshaft 28 via the bearings 23, 25.

A balance weight 37 is secured to the output shaft 26 of the electric motor 15 by means of a nut 38 screwed to the output shaft 26 so as to be abutted against the crank member 29 at the intermediate position of the output shaft 26. A cooling fan 39 is secured to the output shaft 26 at its distal end position.

A cylindrical cylinder 45 is mounted onto the crankcase 11 on the proximal end side. The cylinder 45 communicates with the inside of the crank chamber 12 on the proximal end side of its inner circumferential surface 46. In addition, a cylinder head 50 composed of a valve seat plate 48 and a cylinder head body 49 is mounted on the distal end side of the cylinder 45.

As illustrated in FIG. 2, a suction chamber 51 communicating with the outside and a discharge chamber 52 communicating with the outside are defined in the cylinder head body 49.

The valve seat plate 48 is interposed between the cylinder 45 and the cylinder head body 49. The valve seat plate 48 is formed with a suction hole 57 adapted to allow the suction chamber 51 to communicate with a compression chamber 61 provided on the side of the cylinder 45 and with a discharge hole 58 adapted to allow the discharge chamber 52 to communicate with the compression chamber 61. A suction valve 59 and a discharge valve 60 which are reed valve are attached to the valve seat plate 48. The suction valve 59 and the discharge valve 60 each have a proximal end side secured to the valve seat plate 48 with screws or the like and serving as a fixed end and a distal end side serving as a free end.

A swing-type piston 63 is slidably inserted and fitted into the cylinder 45. The piston 63 includes a swing member 41 composed of a circular connecting portion 54, a rod-like piston rod portion 47 and a disk-like receiving portion 40; a disk-like ring holding member 42; and a disk-like ring holding member 56. The circular connecting portion 54 is rotatably connected via a bearing 53 to the eccentrically rotating crank member 29 located in the crank chamber 12 and at one end side of the piston 63. The rod-like piston rod portion 47 is formed integrally with the connecting portion 54 to radially extend into the cylinder 45. The disk-like receiving portion 40 is formed integrally with the piston rod portion 47 and provided on the side opposite the connecting portion 54 so as to have the center aligned with that of the piston rod portion 47. The disk-like ring holding member 42 is coaxially screwed to the receiving portion 40 of the swing member 41. The disk-like ring holding member 56 is fitted to the disk-like ring holding member 42. The receiving portion 40 of the swing member 41, the ring holding member 42 and the ring holding member 56 located on the other end side of the piston 63 are connected to each other and are reciprocated while swinging in the cylinder 45 to define the compression chamber 61 between the cylinder head 50 and the piston. Incidentally, the ring holding members 42, 56 may be formed into a single piece.

The ring holding members 42 and 56 are screwed to the disk-like receiving portion 40 to define a circular piston ring groove 64 recessed radially inwardly, therebetween on the outer circumferential side of the piston 63. Thus, the ring holding members 42 and 56 are formed with a flange portion 66 on the side opposite the piston rod portion 47 (on the side of the compression chamber 61) and with a flange portion 67 on the side of the piston rod portion 47 respectively, so that the piston ring groove 64 is defined between the flange portions 66 and 67. A piston ring 44 is attached to the piston ring groove 64 between both the flange portions 66 and 67 so as to seal between the piston 63 and the cylinder 45.

The piston ring 44 is made of a resin material superior in wear resistance and in self-lubricating and formed generally circularly. The piston ring 44 is shaped in general rectangle in cross-section so as to have a radial width uniform along a generally full circle. The piston ring 44 is formed with a closed gap portion in a circumferential direction so that its diameter can be reduced and increased through the closed gap portion while maintaining sealing performance. Additionally, when the piston 63 is at the top dead center position or the bottom dead center position, its inner diameter in the state where the piston ring 44 is in contact with the inner circumferential surface 46 of the cylinder 45 is greater than the minimum diameter of the piston ring groove 64. Thus, the piston ring 44 can shift in a radial direction with respect to the piston 63. In addition, the piston ring 44 can turn relative to the piston 63 because of being structured not to restrict the turn.

A structure of the piston ring 44 is described in detail by use of FIGS. 4A, 4B and 4C. FIG. 4A is a plan view, FIG. 4B is a lateral view and FIG. 4C is a cross-sectional view taken along line A-A of FIG. 4A.

The piston ring 44 whose shape is illustrated in FIGS. 4A to 4C is made of a resilient resin material superior in wear resistance and in self-lubricating and generally circularly molded into a single piece. The piston ring 44 includes a generally circular main annular section 88, a circular base section 89 and a circular base section 90. The base section 89 is located at one end of the main annular section 88 in the circumferential direction, shifted to one end thereof in the axial direction and formed thinner than the main annular section 88. The base section 90 is located at the other end of the main annular section 88, shifted to the other end in the axial direction and formed thinner than the main annular section 88. Both the base sections 89 and 90 are shifted from each other in the axial direction of the piston ring 44 and overlap each other in the circumferential direction, whereby mating surfaces 89*a* and 90*a* in contact with each other are formed. The total axial length obtained by adding the respective axial lengths of the base sections 89 and 90 together is equal to the axial length of the main annular section 80.

These base sections 89, 90 constitute the closed gap portion 91. That is to say, both the base sections 89 and 90 constituting the closed gap portion 91 are circumferentially shifted from each other, thereby allowing for expansion and contraction of the piston ring 44. The piston ring 44 is formed with a circumferential closed gap 92 between the base section 89 provided on the one end side of the main annular section 88 in the circumferential direction and the other end portion of the main annular section 88 in the natural state. Similarly, a closed gap 93 is defined between the base section 90 provided on the other end portion of the main annular section 88 and the one end portion of the main annular section 88. When the piston ring 44 is expanded and contracted, these closed gaps 92 and 93 are enlarged and contracted.

In the present embodiment, the ring holding member 42 is screwed to the disk-like receiving portion 40 to define the circular guide ring groove 65 recessed radially inwardly, on the outer circumferential side of the piston. The generally disk-like guide ring 43 is attached to the guide ring groove 65 so as to secure the ring holding member 42 and the cylinder 45 centrally and coaxially with each other. FIGS. 5A and 5B illustrate a shape of the guide ring 43. FIG. 5A illustrates the guide ring 43 as viewed from the side of the piston rod portion 47 and FIG. 5B is a cross-sectional view taken along line A-A of FIG. 5A. The guide ring 43 is formed with a skirt section 71 adapted to increase a contact surface between the guide ring 43 and an inner wall surface 46 of the cylinder 45.

Parts in the vicinity of the head of the piston to which the piston ring 44 and the guide ring 43 are attached are disassembled as illustrated in FIGS. 6 and 7. Incidentally, a tension ring 44*t* illustrated in FIG. 7 is fitted into the inside of the piston ring 44 to expand the piston ring 44 outwardly through its expanding force. Thus, the tension ring 44*t* urges the piston ring 44 to adhere tightly to the inner circumferential surface 46 of the cylinder 45.

The connecting portion 54 is eccentrically rotated by the rotation of the crank member 29, and the piston ring 44 and the guide ring 43 held by the ring holding member 42 are slidably guided by the inner circumferential surface 46 of the cylinder 45. In this way, the piston 63 is reciprocated in the cylinder 45 while the ring holding members 42 and 56 swing in a direction perpendicular to the crankshaft.

Figure 8A:
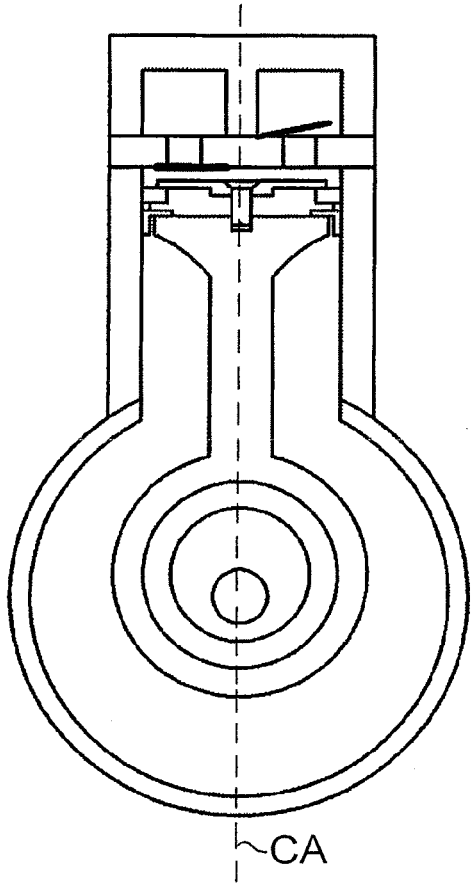
FIG. 8A illustrates a condition where the piston is at top dead center.
Figure 8B:
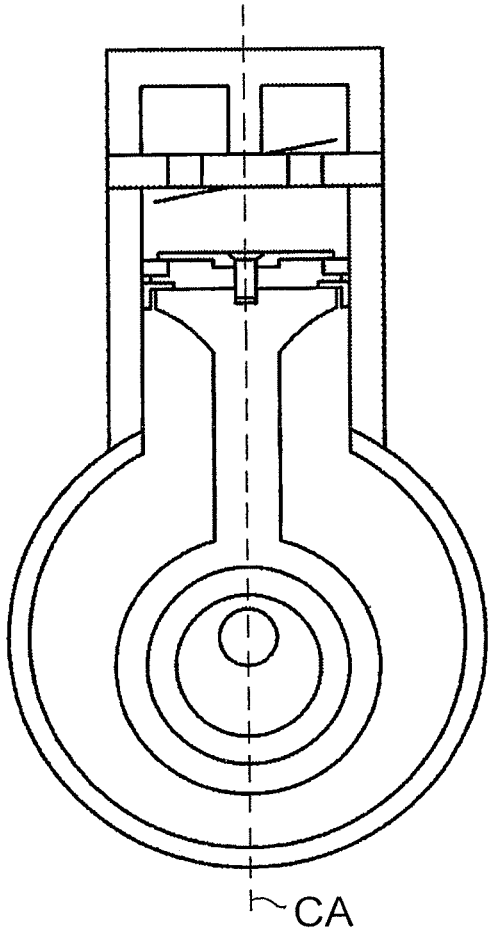
FIG. 8B illustrates a condition where the piston is at bottom dead center.
Figure 8C:
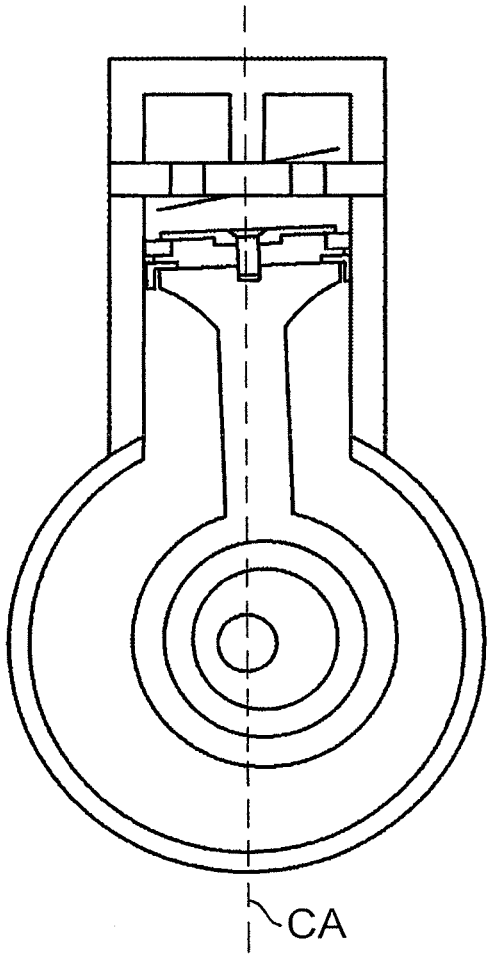
FIG. 8C illustrates a condition where a swing angle of the piston with respect to the piston is maximized.

The configuration of the reciprocative compressor 10 according to the embodiment is as described above. The operation of the compressor 10 is next described by use of FIGS. 8A to 8C in addition to the previous figures. FIG. 8A illustrates a condition where the piston is at the top dead center. FIG. 8B illustrates a condition where the piston is at the bottom dead center. FIG. 8C illustrates a condition where a swing angle of the piston with respect to the cylinder is maximized.

When the electric motor 15 is drivingly rotated, the crank member 29 secured to the output shaft 26 thereof performs eccentrically rotating movement. Then, the piston 63 rotatably connected to the crank member 29 via the bearing 53 allows the ring holding members 42 and 56, the piston ring 44 and the guide ring 43 to reciprocate in the cylinder 45. In a suction stroke, the ring holding member 56 and the piston ring 44 are moved toward the direction opposite the cylinder head 50 to enlarge the compression chamber 61 and to open the suction valve 59 with the discharge valve 60 remaining closed, introducing gas into the compression chamber 61. In a subsequent compression stroke, the ring holding member 56 and the piston ring 44 are moved toward the cylinder head 50 to contract the compression chamber 61 and to open the discharge valve 60 with the suction valve 59 remaining closed, discharging the compressed gas from the compression chamber 61 into the discharge chamber 52 in the cylinder head 50.

In the operation described above, the ring holding member 56 and the piston ring 44 reciprocate in the cylinder 45 while swinging.

More specifically, at the bottom dead center where the compression chamber 61 is most enlarged, the piston 63 is coaxial with the cylinder 45 (FIG. 8B). From this state, the crank member 29 is rotated counterclockwise to perform the compression stroke to move the ring holding members 42, 56, the piston ring 44 and the guide ring 43 in the direction of contracting the compression chamber 61. Then, up to the middle between the top dead center and the bottom dead center, the connecting portion 54 is eccentrically rotated while being moved upward. Consequently, in the middle between the top dead center and the bottom dead center, the connecting portion 54 is located closest to the cylinder 45 (FIG. 8C). In this case, the ring holding members 42, 56 are most tilted with respect to the central axis CA of the cylinder 45.

Subsequently, in the middle of movement toward the top dead center, the ring holding members 42 and 56 generate the maximum downward force F resulting from force based on its own weight and from a centrifugal force based on swing. However, the guide ring 43 restricts the downward movement of the ring holding members 42 and 56. Therefore, the piston ring groove 64 is maintained in the state where its center is generally coincident with the center of the cylinder 45 so that the piston ring 44 is maintained in the state where its center is generally coincident with the ring holding member 42. Thereafter, at the top dead center where the compression chamber 61 is most contracted, the piston 63 becomes coaxial with the cylinder 45, and thus the compression stroke is ended (FIG. 8A).

When the crank member 29 is rotated to perform the suction stroke from the state where the ring holding member 42 is at the top dead center, the piston 63 moves the ring holding members 42 and 56, the piston ring 44 and the guide ring 43 in the direction of enlarging the compression chamber 61. Then, up to the middle between the top dead center and the bottom dead center, the connecting portion 54 is eccentrically rotated while being moved downward. Consequently, the connecting portion 54 is located closest to the cylinder side in the middle between the top dead center and the bottom dead center. In this case, the ring holding member 42 is most tilted with respect to the central axis of the cylinder 45.

Subsequently, the connecting portion 54 returns to the center as the piston 63 goes toward the dead bottom center. At the bottom dead center where the compression chamber is most enlarged, the piston 63 becomes coaxial with the cylinder 45, and thus the suction stroke is ended.

According to the embodiment described above, the guide ring restricts the downward movement of the ring holding members 42 and 56 resulting from the maximum downward force F generated during the compression stroke. Therefore, the piston ring groove 64 is maintained in the state where its center is generally coincident with the center of the cylinder 45. In this way, the piston ring 44 is constantly located at the center of the ring holding member 42. Thus, it is possible to prevent falling-off of the piston ring 44 from the ring holding member 42 due to the pressure of compressed air, the pressure of compressed air being generated by the central misalignment between the piston ring 44 and the ring holding member 42.

Since the guide ring 43 is attached and screwed to the guide ring groove 65, the center of the guide ring 43 is coincident with that of the ring holding member 42. When the cylinder 45 is assembled to the crankcase 11, the guide ring 43 comes into contact with the cylinder internal wall surface 46 to determine the assembly position of the cylinder 45. In this way, the center of the cylinder 45 is coincident with that of the ring holding member 42. Thus, it becomes possible to perform centering between the cylinder 45 and the piston ring 44 attached onto the ring holding member 42.

The guide ring 43 can achieve a product breakage measure which can prevent the contact between the ring holding members 42, 56 and the cylinder 45 due to worn piston ring 44.

Since the guide ring 43 is held between the ring holding member 42 and the receiving portion 40, it is possible to prevent compression heat generated in the compression chamber 61 from being transmitted from the ring holding member 42 to the piston rod portion 47. This can lower the temperature of a large end portion of the piston rod portion 47. Thus, the life of the bearing 53 can be extended.

Figure 9A:
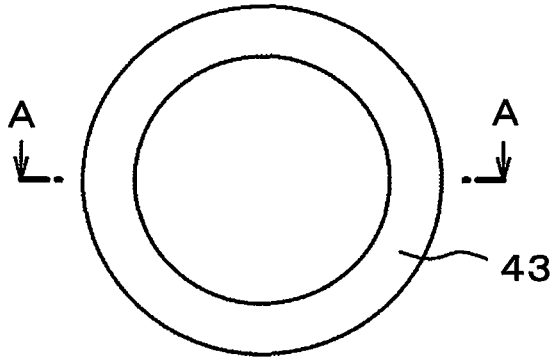
FIGS. 9A and 9B are views for assistance in explaining the shape of a guide ring according to a first modification of the present embodiment.
Figure 9B:
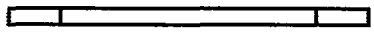
Figure 10:
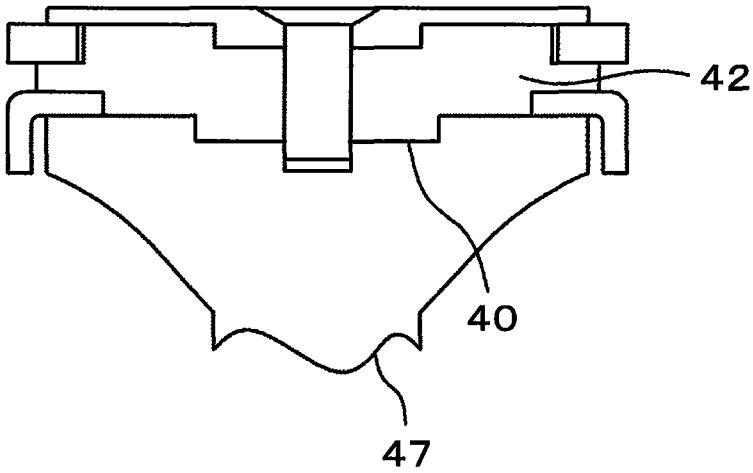
FIG. 10 is an enlarged view illustrating the vicinity of an upper portion of a piston according to a second modification of the present embodiment.
Figure 11:
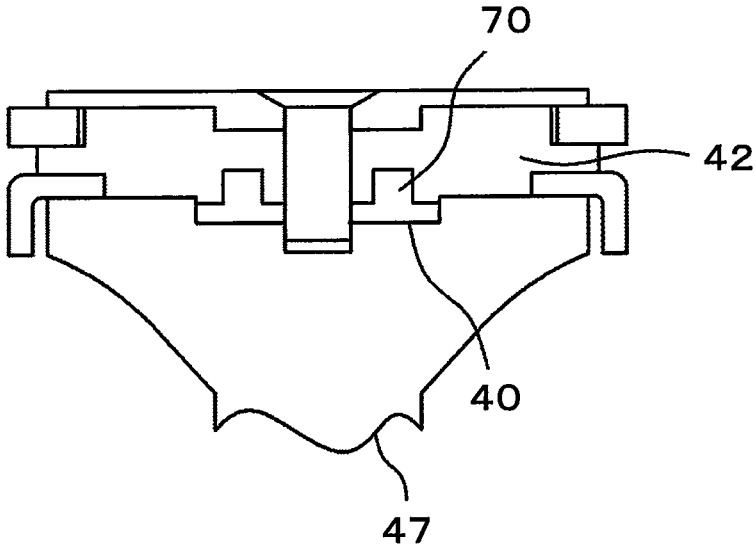
FIG. 11 is an enlarged view illustrating the vicinity of an upper portion of a piston according to a third modification of the present embodiment.
Figure 12:
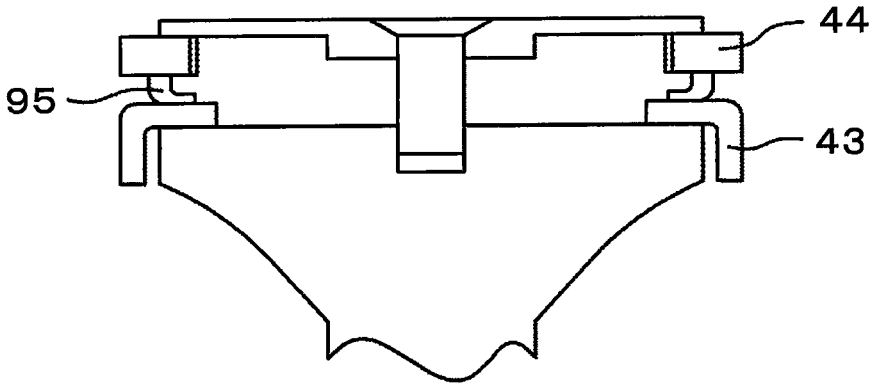
FIG. 12 is an enlarged view illustrating the vicinity of an upper portion of a piston according to a fourth modification of the present embodiment.

Various modifications of the first embodiment according to the present invention are described by use of FIGS. 9 to 11. FIGS. 9A and 9B are views for assistance in explaining a shape of a guide ring according to a first modification of the first embodiment. FIG. 10 is an enlarged view illustrating the vicinity of an upper portion of a piston according to a second modification of the first embodiment. FIG. 11 is an enlarged view illustrating the vicinity of an upper portion of a piston according to a third modification of the first embodiment. FIG. 12 is an enlarged view illustrating the vicinity of an upper portion of a piston according to a fourth modification of the first embodiment.

The first modification relates to the shape of a guide ring 43. Although the guide ring 43 of the first embodiment has the skirt section 71 as illustrated in FIG. 5, the guide ring 43 of the first modification is shaped in rectangle in cross-section as illustrated in FIG. 10 by removing the skirt section 71 from the guide ring 43.

The second modification relates to the shape of a ring holding member 4 and of a receiving portion 40. In the second modification, the receiving portion 40 is formed with a step as illustrated in FIG. 10. The ring holding member 42 and the receiving portion 40 are fitted to each other so that the center of the piston rod portion 47 can be allowed to coincide with that of the ring holding member 42.

In addition to the configuration of the second modification, the third modification is further provided with a heat-insulating air layer 70 between the ring holding member 42 and the receiving portion 40. This heat-insulating air layer 70 can prevent heat generated by the compressed air compressed in the compression chamber 61 from being transmitted to the large end portion of the piston rod portion 47. Thus, the life of the bearing 53 can be extended.

Referring to FIG. 12, a reinforcing plate 95 for supporting the piston ring 44 is provided in a fourth modification. The reinforcing plate 95 can support the piston ring 44 for prevention of its wobbling and also firmly secure the guide ring 43.

Second Embodiment

Figure 14:
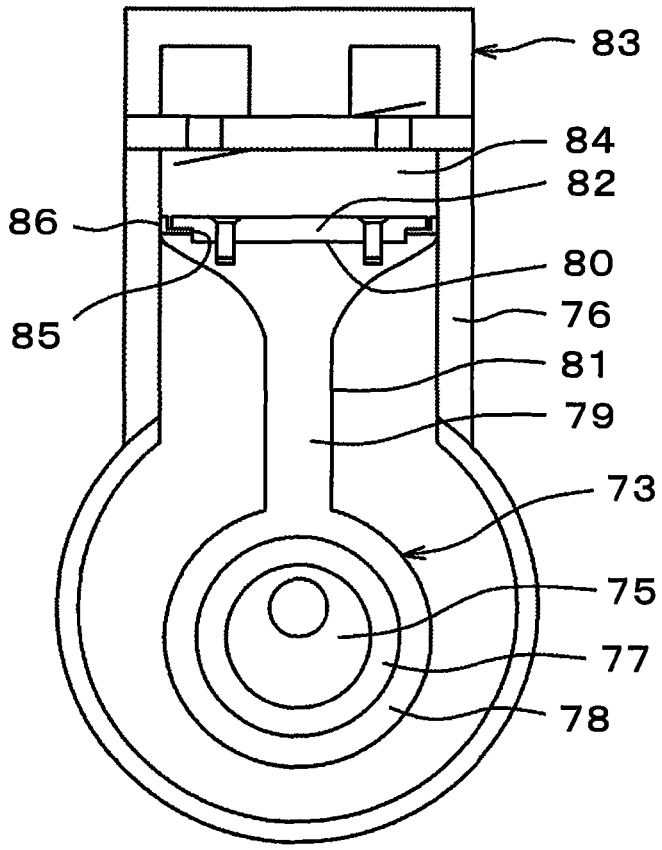
FIG. 14 is a cross-sectional view of the reciprocative compressor according to the second embodiment taken along line I-I of FIG. 13.
Figure 15:
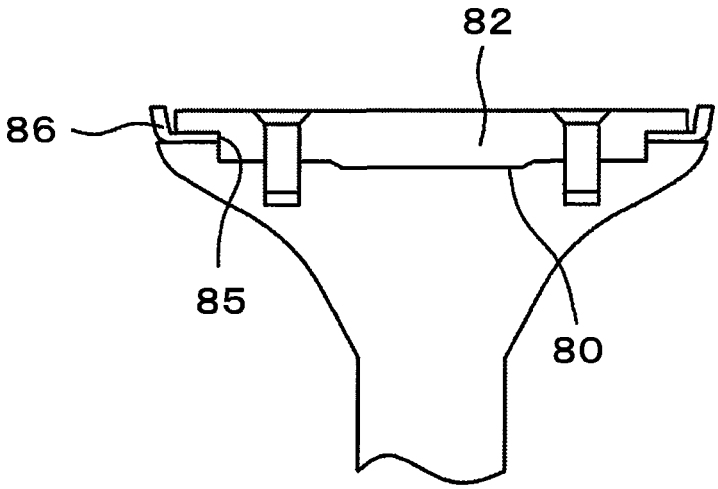
FIG. 15 is an enlarged view illustrating the vicinity of an upper portion of a piston of the reciprocative compressor according to the second embodiment of the present invention.

A second embodiment of the present invention is hereinafter described by use of FIGS. 13 to 15.

The compression stroke is of one-stage compression in the first embodiment; however, the compression stroke in the second embodiment is of two-stage compression. FIG. 13 is a cross-sectional view of a reciprocative compressor according to the second embodiment of the present invention. FIG. 14 is a cross-sectional view of the reciprocative compressor according to the second embodiment taken along line II-II of FIG. 13. FIG. 15 is an enlarged view illustrating the vicinity of an upper portion of a piston of the reciprocative compressor according to the second embodiment of the present invention.

Figure 13:
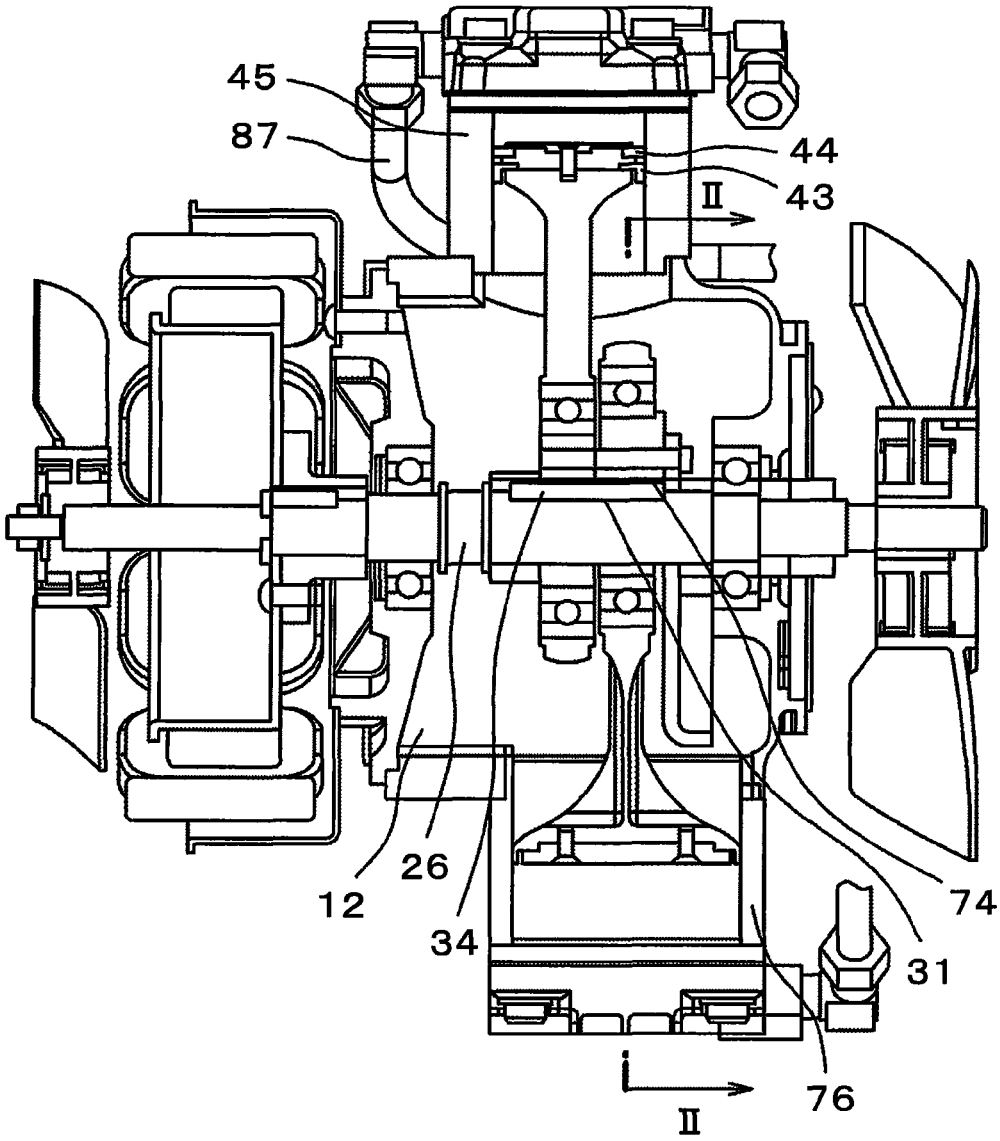
FIG. 13 is a cross-sectional view of a reciprocative compressor according to a second embodiment of the present invention.

Referring to FIG. 13, a piston 73 having a lip ring 86 is connected to an output shaft 26 of the reciprocative compressor of the present embodiment as well as a piston 63 having a piston ring 44 and a guide ring 43 attached to a piston ring groove 64 and a guide ring groove 65, respectively, in the follow manner. A key 34 is fitted into a key groove 74 formed on the crank member 75 and into a key groove 31 formed on the output shaft 26, whereby a crank member 75 is united with the output shaft 26.

The swing-type piston 73 is slidably inserted and fitted into a cylinder 76. The piston 73 includes a swing member 81 composed of a circular connecting portion 78, a rod-like piston rod portion 79 and a disk-like receiving portion 80; and a disk-like ring holding member 82. The circular connecting portion 78 is rotatably connected via a bearing 77 to the crank member 75 located on one end side of the piston 73 and eccentrically rotated in a crank chamber 12. The rod-like piston rod portion 79 is formed integrally with the connecting portion 78 to radially extend into the cylinder 76. The disk-like receiving portion 80 is formed integrally with the piston rod portion 79 on the side opposite the connecting portion 78 so as to have the center aligned with that of the piston rod portion 79. The disk-like ring holding member 82 is coaxially screwed to the receiving portion 80 of the swing member 81. The receiving portion 80 of the swing member 81 located on the other end of the piston 73 and the ring holding member 82 are connected to each other and are reciprocated while swinging in the cylinder 76 to define a compression chamber 84 between the cylinder head 83 and the piston 73. The lip ring 86 is attached to a lip ring groove 85 defined between the ring holding portion 82 and the receiving portion 80. Incidentally, the operation of the compression stroke is the same as that described in the first embodiment.

In the present embodiment, primary compression is performed by the piston 73 having the lip ring 86 to compress air. The air thus compressed is delivered via a pipe 87 into the cylinder 45 in which secondary compression is performed by the piston 63 having the piston ring 44 and the guide ring 43. FIG. 15 is an enlarged view illustrating an essential portion of the piston 73 having the lip ring 86.

According to the present embodiment described above, two-stage compression can be performed using the swing-type piston advantageous in cost for both the primary and secondary compression sides; therefore, air compression can be done effectively.

A modification of the present embodiment is next described below.

The two-stage compressor may be configured to use the piston ring 44 in the primary compression part.

The two-stage compressor may be configured such that both the primary compression and the second compression are performed by means of the piston 63 having both the piston ring 44 and the guide ring 43. Since the piston ring 44 can compress higher-pressure air than the lip ring 86, the configuration using the piston ring 44 can compress higher-pressure air in the primary compression although increasing manufacturing cost. Thus, compressor efficiency can be increased to allow for further high-pressurization as the overall compressor.

What is claimed is:

1. A reciprocative compressor comprising:

a cylinder having a longitudinal cylinder axis;

a swing piston having a longitudinal piston axis with one end side as a connecting portion rotatably connected to a crankshaft and the other end side swingably reciprocating in the cylinder as the piston moves between top dead center and bottom dead center, the piston comprising a receiving portion, a ring holding member, and a top flange portion at the other end side of the piston; and a piston ring groove located on an outer circumferential side of the piston formed by the top flange portion and the ring holding member;

a piston ring attached to the piston ring groove to seal between the piston and an inner surface of the cylinder;

a ring groove on the outer circumferential side of the piston at the crankshaft side of the piston ring groove;

the ring groove provided separately from the piston ring groove and axially separated from the piston ring groove along the longitudinal piston axis; and a guide ring provided in the ring groove axially separated from the piston ring groove having a skirt section extending away from the piston ring and restricted from moving in a radial direction by contact between a skirt section outer surface and the inner surface of the cylinder such that the guide ring skirt section does suppress radial movement of said piston ring when said longitudinal piston axis is tilted with respect to said longitudinal cylinder axis.

2. The reciprocative compressor according to claim 1, wherein the piston ring is formed to be capable of increase and reduction in diameter by having a closed gap portion.

3. The reciprocative compressor according to claim 1, wherein the skirt section opens toward the crankshaft.

4. The reciprocative compressor according to claim 1, wherein a reinforcing plate is secured between the piston ring and the guide ring.

5. The reciprocative compressor according to claim 1, wherein the ring holding member and the receiving portion define steps for fitting to each other.

6. The reciprocative compressor according to claim 5, wherein a heat insulating layer is provided between the ring holding member and the receiving portion.

7. The reciprocative compressor according to claim 1, wherein a heat insulating layer is provided between the ring holding member and the receiving portion.

* * * * *